United States Patent [19]

Price

[11] 4,305,232

[45] Dec. 15, 1981

[54] GRINDING SYSTEM

[75] Inventor: Ralph E. Price, Waynesboro, Pa.

[73] Assignee: Litton Industrial Products, Inc., Waynesboro, Pa.

[21] Appl. No.: 133,715

[22] Filed: Mar. 25, 1980

[51] Int. Cl.[3] ..... B24B 5/42

[52] U.S. Cl. ..... 51/105 SP

[58] Field of Search ..... 51/105 R, 105 SP; 29/38 B

[56] References Cited

U.S. PATENT DOCUMENTS

| | | | |
|---|---|---|---|
| 2,128,186 | 8/1938 | Jones | 29/38 B |
| 2,813,381 | 11/1957 | Narel | 51/105 R |
| 3,113,404 | 12/1963 | Narel | 51/105 R |
| 3,683,724 | 8/1972 | Crane | 29/38 B |

*Primary Examiner*—Harold D. Whitehead

*Attorney, Agent, or Firm*—Spencer T. Smith

[57] ABSTRACT

A grinding system for grinding the crankpins on a crankshaft having an even plurality of symmetrically spaced pins comprising a number of cylindrical grinding machines equal to half the plurality of pins each for grinding a single pin located at a distinct radial and axial position, apparatus for depositing a crankshaft at a selected start location, apparatus for displacing the crankshaft from the selected start location sequentially to each of the grinding machines and to an end location so that half of the pins will be ground, apparatus for transferring the crankshaft, with half of its pins ground, from the end location to the start location and for turning the crankshaft end for end so that the crankshaft will be again displaced by the displacing apparatus sequentially to the grinding machines so that the remaining half of the pins will be ground.

5 Claims, 7 Drawing Figures

GRINDING SYSTEM

The present invention relates to cylindrical grinding machines for machining the crankpins on an automobile or other internal combustion engine having a plurality of crankpins.

Since the early 1900's, the crankpins on a multi pin crankshaft could be machined in a manually controlled machine by changing the axial and/or rotary position of the crankshaft to present each pin in sequence to a predetermined grind position.

In the 1950's, automatic crankpin grinding systems were first introduced for automatically grinding all of the plurality of pins on a multi pin crankshaft without manual intervention. A corresponding plurality of grinding machines, each dedicated to a single pin, were connected in series by loaders to achieve this automation. U.S. Pat. No. 2,899,778 discloses such a one pin-one machine system. Later, a fully automated machine was introduced to automatically grind all of the plurality of pins in a single machine (U.S. Pat. No. 3,118,258).

In the 1970's, an advanced one pin-one machine transfer line system was introduced and such system is disclosed in U.S. Pats. Nos. 4,003,721 and 4,030,252.

It is an object of the present invention to increase the flexibility of a one pin-one machine transfer line crankpin grinding system.

Other objects and advantages of the present invention will become apparent from the following portion of this specification and from the accompanying drawings which illustrate, in accordance with the mandate of the patent statutes, the presently preferred embodiment incorporating the principles of the invention.

Referring to the drawings.

Figure 1:
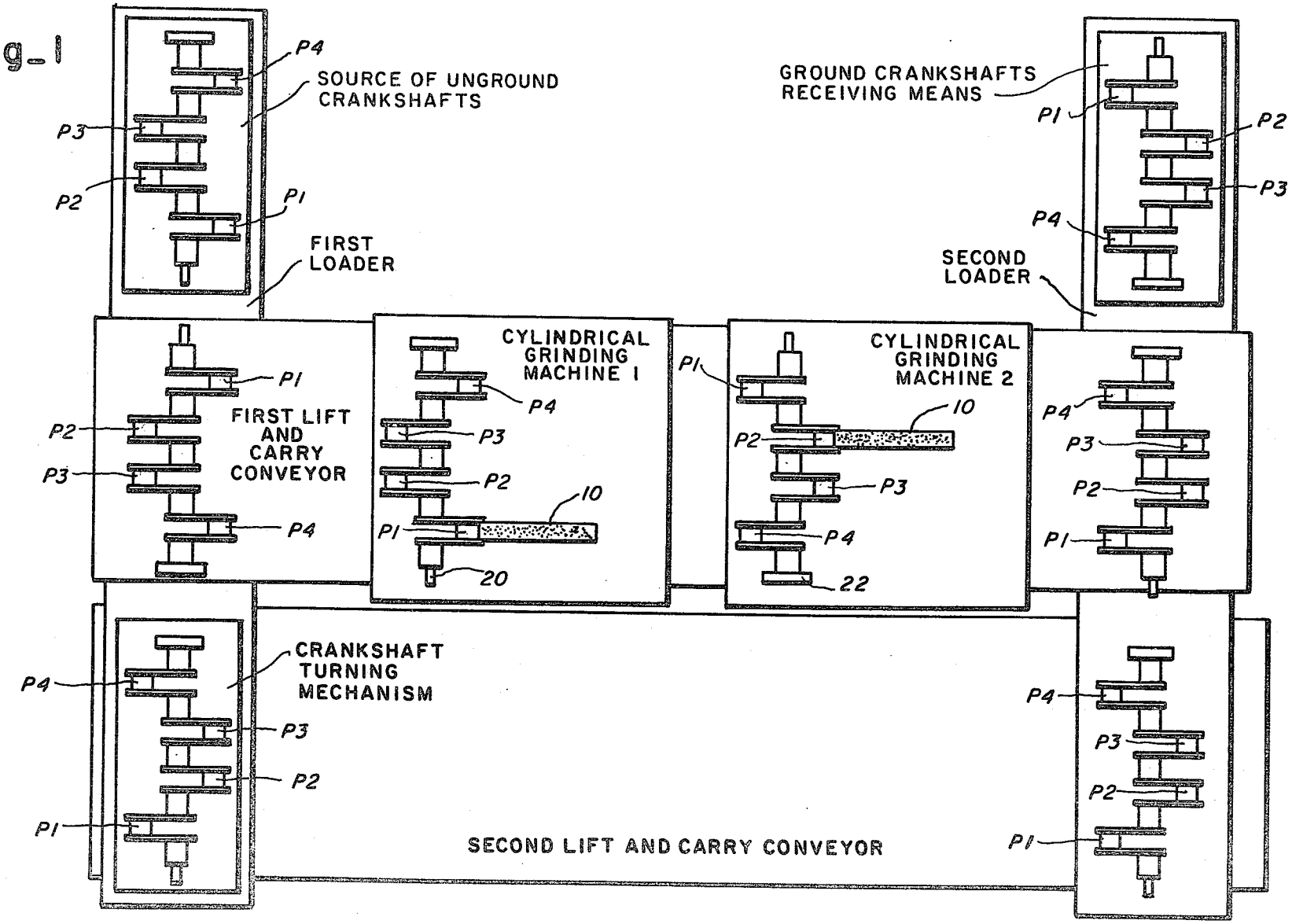
FIG. 1 is a schematic diagram of an automatic crankpin grinding system made in accordance with the teachings of the present invention in one dynamic condition.
Figure 2:
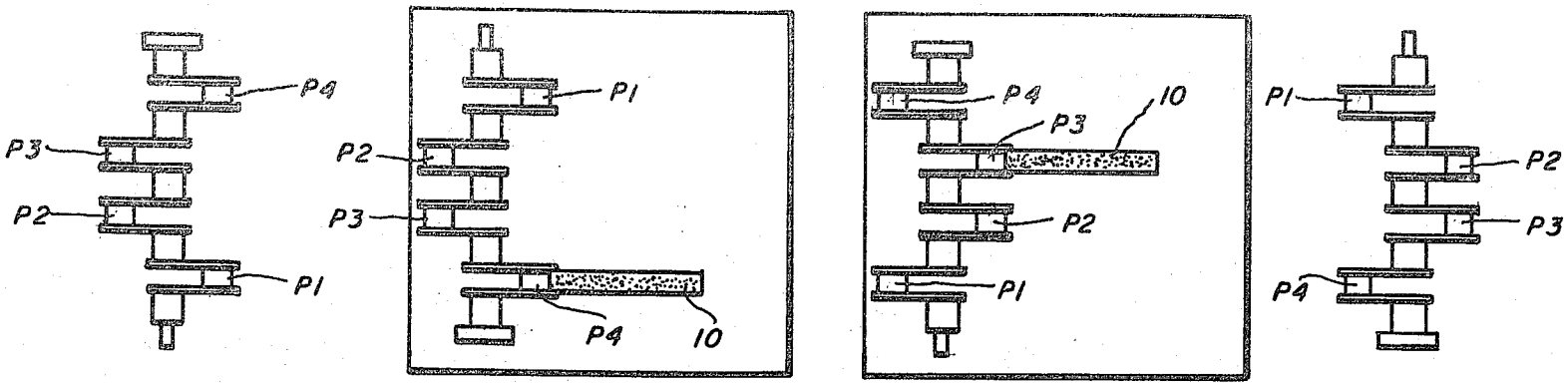
FIG. 2 is a view showing a portion of the invention shown in FIG. 1 in a second dynamic condition.
Figure 7:
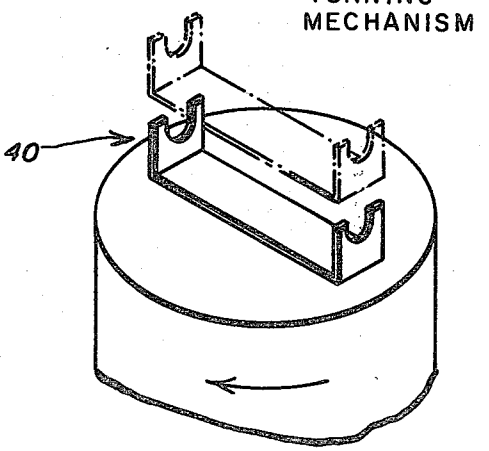
FIG. 7 is an oblique view of the crankshaft turning mechanism illustrated in FIG. 6.
Figure 6:
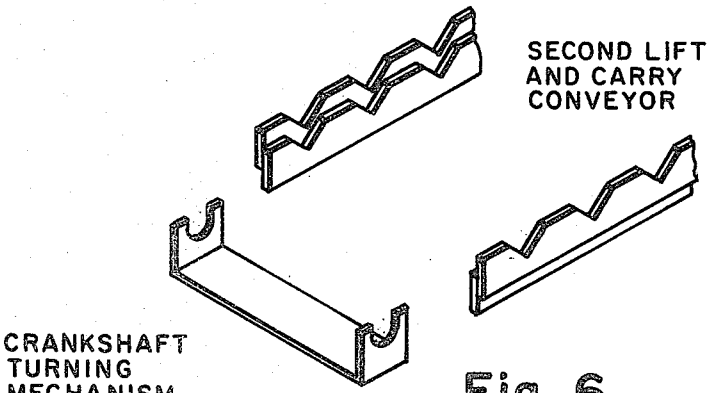
FIG. 6 is an oblique view of a portion of the Second Lift And Carry Conveyor schematically illustrated in FIG. 1.

The basic components of the crankpin grinding system are disclosed in FIGS. 1 and 2. A First Lift And Carry Conveyor feeds crankshafts from a start position (left-hand end) sequentially through Cylindrical Grinding Machines 1 and 2 to an end position (right-hand end). A Second Lift And Carry Conveyor extends parallel to the first and has reversed start and end positions. The end position of this second conveyor is defined by a Crankshaft Turning Mechanism.

A First Loader operatively interconnects the Source of Unground Crankshafts which sequentially presents a crankshaft at a selected ready position (shown), the start position of the first conveyor and the end position of the second conveyor.

A Second Loader operatively interconnects the end position of the first conveyor, the start position of the second conveyor and the Ground Crankshaft Receiving Means which sequentially transfers the ground crankshafts from a selected receiving position (shown).

Figure 3:
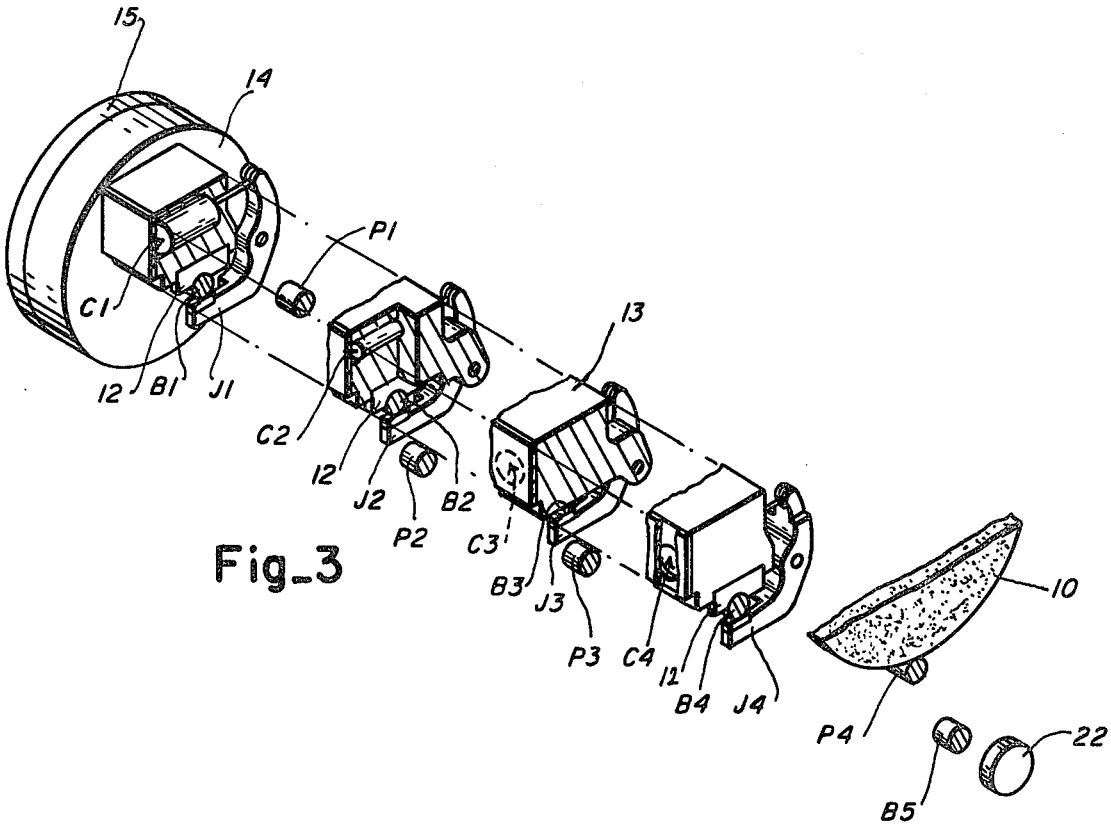
FIG. 3 is a partial perspective view of a cylindrical grinder supporting the fourth pin of a four-pin crankshaft in position for grinding.
Figure 4:
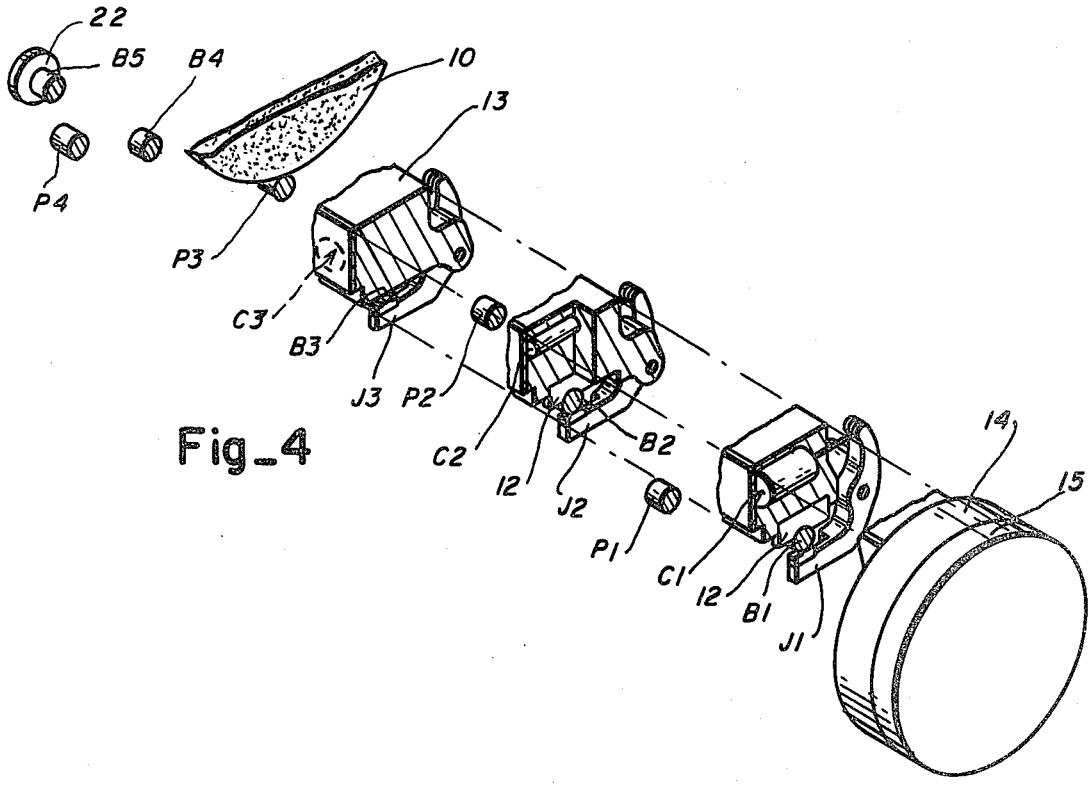
FIG. 4 is a view, similar to that of FIG. 4, of a cylindrical grinder supporting the third pin in a four-pin crankshaft in position for grinding.

The Cylindrical Grinding Machines include a grinding wheel assembly (FIG. 3) having a single rotatable grinding wheel 10 which may be selectively downwardly advanced into abrasive engagement with a crankshaft crankpin having a predetermined axial and radial position. The crankshaft is clamped between blocks 12, which are supported by a base member 13 integrally secured to the drive plate 14 of a rotatable workhead 15, and associated jaw members J1, J2, J3, J4 which are pivotally secured to the base member 13. The throwblocks 12 include a cylindrical workpiece receiving bearing surface 18.

The illustrative crankshaft, which has a post 20 at one end and a flange 22 at the other, is a crankshaft for a four cylinder engine, including five equally spaced coaxial main bearings B1, B2, B3, B4, B5, and two pairs of 180° angularly spaced crankpins P1, P2, P3, P4. The crankpins are also equally (symmetrically) spaced axially (end to end) and are located intermediate adjacent bearings. The end pins define one crankpin pair and the center pins define the other 180° related crankpin pair.

Each jaw member is individually controlled by an associated hydraulic cylinder C1, C2, C3, C4, which is selectively connected to a source of pressurized fluid (not shown). Where the crankpin furthest from the workhead is to be ground (Cylindrical Grinding Machine #1), the clamping assembly includes four throwblocks 12 and four clamps or jaws J1, J2, J3, J4. This crankshaft will be completely unsupported beyond the fourth main bearing B4 when this crankpin is ground to size.

Where the central pin remote from the ground pin is to be ground (Cylindrical Grinding Machine #2), the clamping assembly includes three throwblocks and three clamps or jaw. Additional details of these workheads are disclosed in U.S. Pat. No. 4,003,721.

Figure 5:
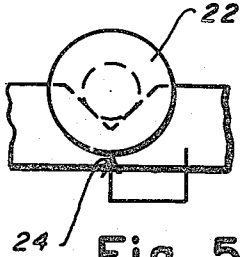
FIG. 5 is a view taken along lines 6—6 of FIG. 1.

In operation, an unground crankshaft is supported at the ready position of the Source of Unground Crankshafts with the flange at the left end relative to its direction of passage through the grinding machines. The First Loader selectively removes the unground crankshaft and places it on the First Lift And Carry Conveyor. The crankshaft is manipulated to present the right-hand end pin (P1) at a predetermined rotary and axial position at the chuck of Cylindrical Grinding Machine #1 and the first pin is ground to size. The details of the Lift And Carry Conveyor are disclosed in U.S. Pat. No. 4,030,252. The crankshaft is further manipulated to present the center pin remote from the ground crankpin (P3) at a predetermined axial and rotary position in Cylindrical Grinding Machine #2 and there ground to size. When the crankshaft is placed at the end position of the First Lift And Carry Conveyor, the flange will actuate a pressure responsive switch 24 secured to the conveyor (FIG. 5) causing the Second Loader to remove the crankshaft and place it at the start position of the Second Lift and Carry Conveyor.

When this crankshaft becomes situates at the end position, the Crankshaft Turning Mechanism, to be subsequently discussed in detail, turns the crankshaft end for end 180 degrees. The First Loader picks up the turned crankshaft and deposits it at the start position of the First Lift and Carry Conveyor. Because of the symmetry of the crankshaft, the end pin proximate the post (P1) is processed by Cylindrical Grinding Machine #1, identically as was pin number P4 previously, and the other central pin (P2) is processed by Cylindrical Grinding Machine #2, identically as was pin number P3 previously.

The Crankshaft Turning Mechanism includes a pair of bearing support members 40 which define the end position of the Second Lift And Carry Conveyor. The bearing support members are supported for vertical displacement downwardly to a lowered position below the Second Lift And Carry Conveyor for rotational movement so that the crankshaft can be rotated 180° end for end. Once rotated, the bearing support members are raised to their elevated position.

The invention claimed is:

1. A grinding system for grinding a plurality of pairs of crankpins axially symmetrically spaced on a crankshaft so that when the crankshaft is turned end for end the axial location of each pair of crankpins may be unchanged comprising a cylindrical grinding machine for each pair of axially symmetrically spaced crankpins, each for grinding a crankpin located at a distinct radial and axial position, means for depositing a crankshaft having both crankpins of each pair of axially symmetrically spaced crankpins unground at a selected start location, means for displacing the crankshaft having both crankpins of each pair of axially symmetrically spaced crankpins unground from the selected start location sequentially to each of said grinding machines and to an end location so that one crankpin of each crankpin pair will be ground, means for transferring the crankshaft, with one crankpin of each crankpin pair ground, from said end location to said start location and for axially symmetrically turning the crankshaft end for end, and means for displacing the crankshaft having one crankpin of each pair of axially symmetrically spaced crankpins ground from the start location sequentially to each of said grinding machines and to said end location so that the second crankpin of each crankpin pair will be ground.

2. A grinding system according to claim 1, wherein said displacing means further comprises means for sensing the presence of an unturned crankshaft at said end location.

3. A grinding system according to claim 1, wherein said transferring and turning means includes a lift and carry conveyor for transporting a crankshaft from a selected start position to a selected end position.

4. A grinding system according to claim 3, wherein said transferring and turning means comprises a selectively elevatable and rotatable crankshaft support member defining at a selected elevation said selected end location.

5. A grinding system according to claim 1, wherein said depositing means or transferring and turning means alternately place a crankshaft at said start location.

* * * * *